US005692743A

United States Patent [19]

Yano et al.

[11] Patent Number: 5,692,743

[45] Date of Patent: Dec. 2, 1997

[54] PAPER TRANSPORT APPARATUS

[75] Inventors: Masahisa Yano, Kanagawa, Japan; Tsutomu Miura, Rochester, N.Y.

[73] Assignee: Eastman Kodak Company, Rochester, N.Y.

[21] Appl. No.: 368,930

[22] Filed: Jan. 5, 1995

[30] Foreign Application Priority Data

Jul. 7, 1994 [JP] Japan ..... HEI 6-155802

[51] Int. Cl.[6] ..... B65H 3/52

[52] U.S. Cl. ..... 271/121

[58] Field of Search ..... 271/121–125

[56] References Cited

U.S. PATENT DOCUMENTS

| | | | |
|---|---|---|---|
| 3,768,803 | 10/1973 | Stange | 271/121 |
| 4,376,530 | 3/1983 | Akai | 271/121 |
| 4,461,465 | 7/1984 | Hartman et al. | 271/121 |
| 4,586,705 | 5/1986 | Satoh et al. | 271/122 |
| 4,589,650 | 5/1986 | Miyoshi | 271/122 |
| 4,613,127 | 9/1986 | Wishart et al. | 271/122 |
| 4,615,518 | 10/1986 | Di Blasio | 271/121 |
| 4,822,023 | 4/1989 | Miyoshi | 271/122 |
| 4,925,062 | 5/1990 | Tsukamoto et al. | 271/121 |

FOREIGN PATENT DOCUMENTS

| | | | |
|---|---|---|---|
| 57142 | 4/1982 | Japan | 271/122 |
| 6156783 | 6/1994 | Japan | 271/122 |
| 6166446 | 6/1994 | Japan | 271/122 |

*Primary Examiner*—William E. Terrell
*Assistant Examiner*—T. Kelly
*Attorney, Agent, or Firm*—Lawrence P. Kessler

[57] ABSTRACT

A paper transport apparatus that can reliably transport sheets of paper without the sheets overlapping or skewing, regardless of the type, size, thickness or condition of the sheets of paper. The paper transport apparatus includes a feed roller for feeding a sheet of paper along a transport path in a transport direction, and a retard roller for moving sheets of paper, other than a sheet to be transported by said feed roller, in a direction opposite to that of the transport direction. The feed roller and the retard roller are arranged in contact and in mutual opposition relative to the transport path. A rotational member is rotatably supported in opposition to the feed roller relative to the transport path. The rotational member is urged against the feed roller such that the rotational member can be moved away from the feed roller, at a location upstream of the position of contact between the retard roller and the feed roller, relative to the transport direction.

1 Claim, 5 Drawing Sheets

PAPER TRANSPORT APPARATUS

BACKGROUND OF THE INVENTION

1. Field of the Invention

The present invention relates to a paper transport apparatus and, more particularly, to a paper transport apparatus used in a copying machine, image capture apparatus, microfilmer, bill counter and other such apparatus.

2. Description of the Prior Art

Copying machines and other such devices use paper transport apparatus to enable sheets of paper placed in a tray to be transported one sheet at a time. FIG. 5 shows an arrangement of a conventional paper transport apparatus. In this arrangement, the paper transport apparatus 1*c* is provided with a tray 60 which holds a stack of paper 70, and a feed baffle 62 that is associated with the tray 60. Arranged on the downstream side of the feed baffle 62 are a feed roller 10 that rotates counter-clockwise (with reference to the drawing) to draw in a sheet of paper to be transported and a retard roller 20 that is arranged in opposition to the feed roller 10 and also rotates counter-clockwise. Provided downstream of the rollers 10 and 20 are an arm 28 pivotably mounted on a shaft, a retard cover spring 29 which serves to move the arm 28, and a retard cover 26 disposed at the front end of the arm 28. A take-away roller 50 is provided before a paper outlet 82.

The operation of the paper transport apparatus 1*c* thus configured will now be described. The counter-clockwise rotation of the feed roller 10 causes multiple sheets of paper to be drawn in the transport direction, and the counter-clockwise rotation of the retard roller 20 serves to urge the sheets of paper other than the topmost sheet in the opposite direction. The feed roller 10 has a coefficient of friction that is higher than that of the retard roller 20, and, as a result, the topmost sheet is transported in the downstream direction. The paper is conveyed to the outlet 82 by the take-away roller 50.

However, there have been problems with the above conventional paper transport apparatus 1*c* that include the fact that the action of the feed roller 10 can cause bending of some types of paper and of paper that has some degree of damage or is curled, or the like, and that sheets that are fed are sometimes skewed or damaged by the action of the retard roller 20.

FIG. 6 shows a paper transport apparatus 1*d* designed to solve the type of problems encountered with the paper transport apparatus 1*c*. While the overall arrangement of the paper transport apparatus 1*d* is the same as that of the paper transport apparatus 1*c*, the feed baffle 62 in paper transport apparatus 1*d* has a feed baffle oscillation finger 66 formed of polyvinyl chloride, or the like, to reduce the effect of the retard roller 20. However, even with the provision of the feed baffle oscillation finger 66, depending on the mutual positions of the feed roller 10 and retard roller 20 relative to the direction of paper transport, the rotation speed of the rollers, the roller material and the type, size and thickness of the paper, the retard roller 20 can still adversely affect the accuracy and stability of the paper transport.

SUMMARY OF THE INVENTION

The object of the present invention is to provide a paper transport apparatus that is able to reliably transport sheets of paper without the sheets overlapping or skewing, regardless of the type, size, thickness or condition of the sheets of paper.

In accordance with the present invention, this object is attained by a paper transport apparatus comprising a feed roller that feeds a sheet of paper in a transport direction, a retard roller that moves sheets of paper other than the sheet to be transported in a direction opposite to that of the transport direction, said rollers being arranged in mutual opposition via the paper transport path, and a rotational member rotatably supported in opposition to the feed roller via the paper transport path, said rotational member being urged against the feed roller from which the rotational member can be moved away.

The object is also attained by the above paper transport apparatus in which the rotational member is provided at a position that is upstream of the position of contact between the retard roller and the feed roller, relative to the transport direction.

With the paper transport apparatus thus configured, a rotational member is provided in opposition to the feed roller against which it is urged and relative to which it can be swung, so that when multiple sheets of paper are fed between the feed roller and the retard roller, the rotational member is moved downward and the extra sheets are returned by the retard roller. When one sheet is fed and when multiple sheets are fed and the extra sheets are returned, secure contact between the sheet and the feed roller is provided by the rotational member, and the sheet is, therefore, reliably transported. As the rotational member is rotatably supported and rotates with the movement of each sheet, the rotational member does not affect the transport of the paper. Moreover, in accordance with a further arrangement of the paper transport apparatus, the rotational member is disposed at a position that is upstream of the position of contact between the retard roller and the feed roller, relative to the paper transport direction, the effect of which is to ensure that each sheet of paper is reliably transported by preventing a sheet being moved back by the retard roller before the sheet can be taken by the feed roller.

Further features of the invention, its nature and various advantages will become more apparent from the accompanying drawings and following detailed description of the invention.

DESCRIPTION OF THE PREFERRED EMBODIMENT

Figure 1:
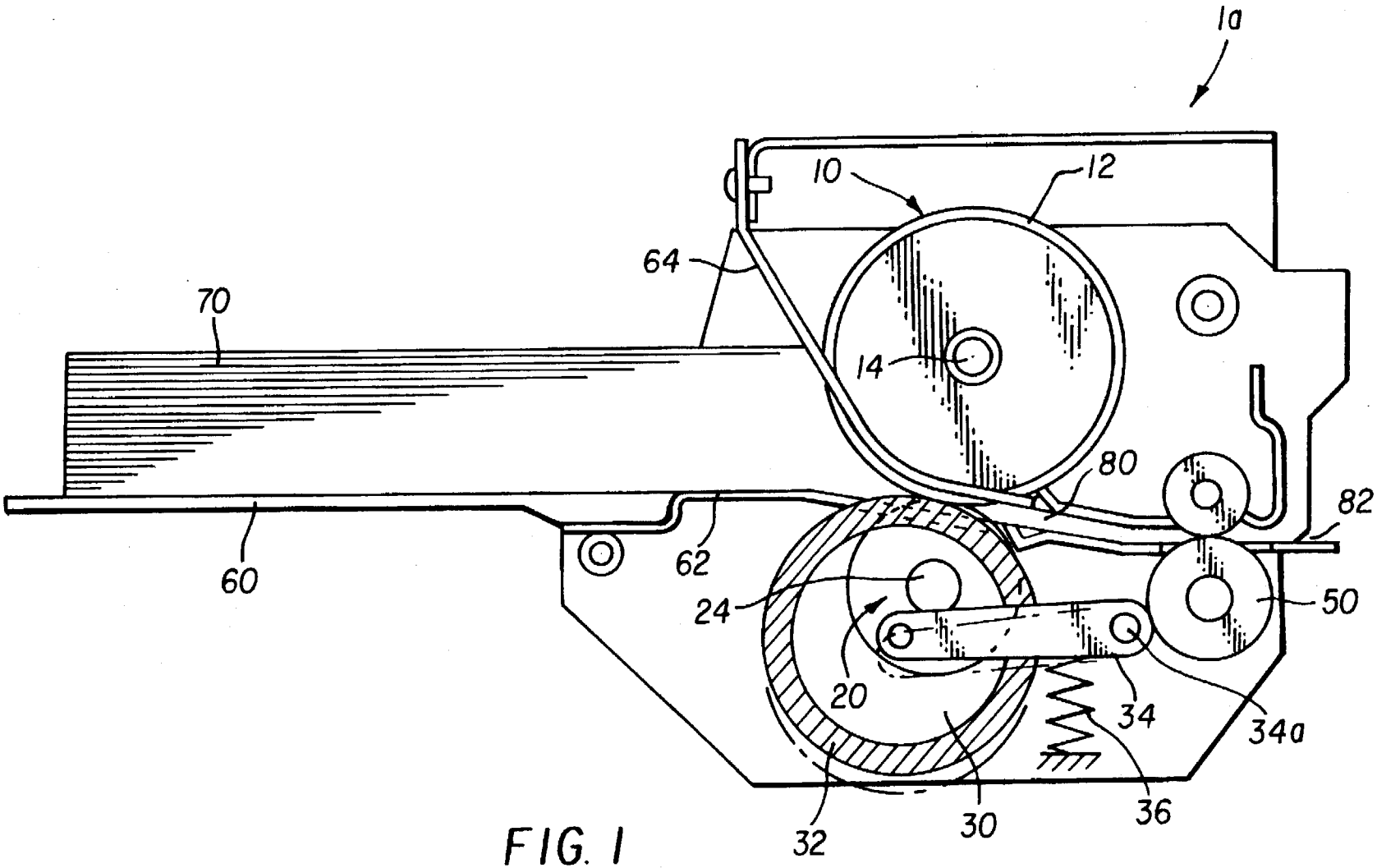
FIG. 1 is a frontal view showing the arrangement of an embodiment of a paper transport apparatus according to the present invention.

A first embodiment of the paper transport apparatus of the present invention will now be described with reference to FIGS. 1 and 2. In the drawings, a paper transport apparatus 1*a* is provided with a tray 60, which holds a stack of paper 70, and a feed baffle 62 disposed on the downstream side of the tray 60. The feed baffle 62 constitutes the paper transport path up to the point at which the paper comes between a feed roller 10 and retard roller 20 that are arranged on the downstream side of the feed baffle 62. The rotation of the feed roller 10 (counter-clockwise, with reference to the drawing) serves to move sheets of paper in the required direction of transport, while the rotation of the retard roller 20 (also counter-clockwise, with reference to the drawing) serves to urge sheets of paper in the reverse direction.

Figure 2:
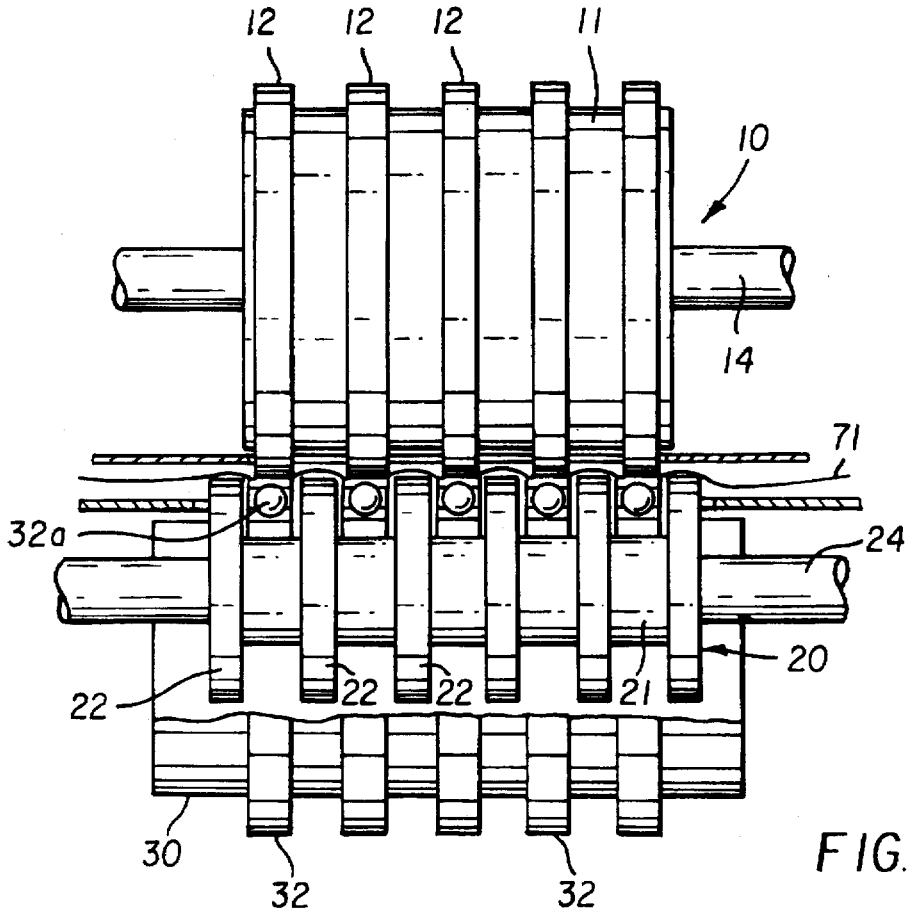
FIG. 2 is a side view showing the relationship of the feed roller, retard roller and pull-in roller in the embodiment of the paper transport apparatus of the invention.

As shown by FIG. 2, the feed roller 10 has a roller body 11 mounted axially on a shaft 14 and five annular members 12 provided on the outer surface of the roller body 11. The roller body 11 and annular members 12 are rotated by the rotation of the shaft 14. The feed roller 10 is housed within an upper cover 64, with part of the feed roller 10 protruding downward from the upper cover 64.

The retard roller 20 is arranged in opposition to the feed roller 10 on the transport path 80. The retard roller 20 has a roller body 21 mounted axially on a shaft 24 and six annular members 22 provided on the outer surface of the roller body 21. The retard roller 20 rotates with the rotation of the shaft 24. As shown by FIG. 2, there is a horizontal alternation between the annular members 12 on the feed roller 10 and the annular members 22 on the retard roller 20.

This embodiment is also provided with a rotational member constituted by pull-in rollers 32. These pull-in rollers 32 are annular members provided on the outer surface of a pull-in cylinder 30 that can be swung by means of an arm 34. The pull-in rollers 32 are provided between the annular members 22 of the retard roller 20 in positions corresponding to the positions of the annular members and can rotate relative to the pull-in cylinder 30. This rotation of the pull-in rollers 32 relative to the pull-in cylinder 30 is facilitated by providing each of the pull-in rollers 32 with a bearing 32*a*. The pull-in cylinder 30 itself does not rotate.

The pull-in rollers 32 can be positioned so that the paper is urged against the feed roller 10 at a constant force. The roller body 21 of the retard roller 20 and the shaft 24, associated with the retard roller 20, are contained within the pull-in cylinder 30 which is provided with an opening (not shown) from which a portion of the annular members 22 protrudes from the pull-in cylinder 30. As shown in FIG. 1, the arm 34 is supported by a pull-in roller spring 36 and pivots about a shaft 34*a*. The pull-in rollers 32 are provided upstream of the retard roller 20, with respect to the direction of paper transport. That is, the center of rotation of the pull-in rollers 32 is on the upstream side of a line connecting the centers of rotation of the feed roller 10 and retard roller 20, whereby the pull-in rollers 32 prevent a sheet being moved in the reverse direction by the retard roller 20 before the sheet can be taken by the feed roller 10. The paper is conveyed out of the paper outlet 82 by a take-away roller 50 provided in front of the paper outlet 82.

The operation of the paper transport apparatus 1*a* according to this arrangement will now be described. A sheet of paper from the stack 70 in the tray 60 is fed in the direction of transport between the feed roller 10 and the pull-in rollers 32 rotated by the feed roller 10. When multiple sheets of paper are fed from the stack 70, the pull-in rollers 32 retract below the feed baffle 62, whereby the force of the moving sheets of paper in the direction of transport is provided only by the feed roller 10, therefore, resulting in the conveyance of the topmost sheet by the feed roller 10. Sheets other than the topmost sheet are urged back toward the tray 60 by the retard roller 20. As there is no paper between the pull-in rollers 32 and the feed roller 10 at this time, the pull-in rollers 32 lose their driving force and rotate together with the movement of the paper back toward the tray 60.

Figure 3:
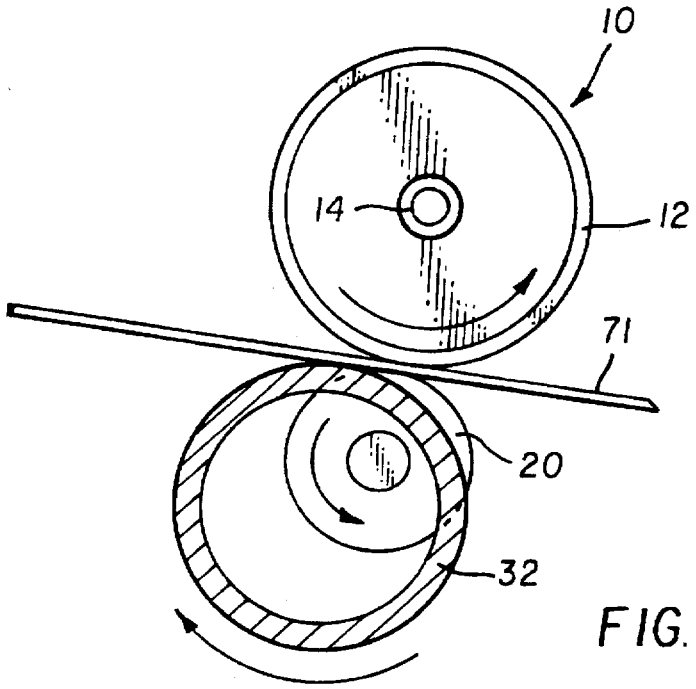
FIG. 3 is an explanatory drawing illustrating the operation of the paper transport apparatus of the invention.

When one sheet is conveyed from the tray 60, as well as when multiple sheets are fed and the extra sheets are urged back toward the tray, that is, when there is a sheet between the feed roller 10 and pull-in rollers 32, the sheet is conveyed forward in the direction of transport. This happens because the pull-in rollers 32 serve to prevent the retard roller 20 from moving a sheet backward before the sheet can be taken by the feed roller 10, thereby permitting the paper to be conveyed in the required direction without hindrance from the retard roller 20. Moreover, even when a sheet that is moving forward in the direction of transport is in contact with the retard roller 20 as well as with the feed roller 10, the relationship among the coefficient of friction $\mu 1$ between the feed roller 10 and the paper, the coefficient of friction $\mu 2$ between the retard roller 20 and the paper and the coefficient of friction $\mu 3$ between the pull-in rollers 32 and the paper is $\mu 1>\mu 2>\mu 3$, meaning that the paper is conveyed forward in the direction of transport because the transporting force of the feed roller 10 exceeds the reversing force of the retard roller 20. When paper is conveyed in the direction of transport, the pull-in rollers 32 rotate in a direction corresponding to the direction of paper movement, as illustrated by FIG. 3.

When the feeding of multiple sheets occurs in the case of the above embodiment, the pull-in rollers 32 move down and the sheets are urged back toward the tray 60 by the retard roller 20. As the pull-in rollers 32 can spin freely, they rotate with the movement of the sheets back toward the tray 60, thereby helping to return the sheets to the tray. On the other hand, when a single sheet is fed, the pull-in rollers 32 prevent the retard roller 20 moving the sheet backward before the sheet can be taken by the feed roller 10. In addition, the pull-in rollers 32 bring the sheet into secure contact with the feed roller 10, and the ability of the pull-in rollers 32 to rotate freely facilitates smooth paper movement by the feed roller 10 and eliminates any need to make complex adjustments to compensate for differences in the type of paper, leading-edge shape, paper condition and coefficient of friction, preventing such transport problems as overlapping and skewing which are a frequent occurrence in conventional paper transport apparatus.

Figure 4:
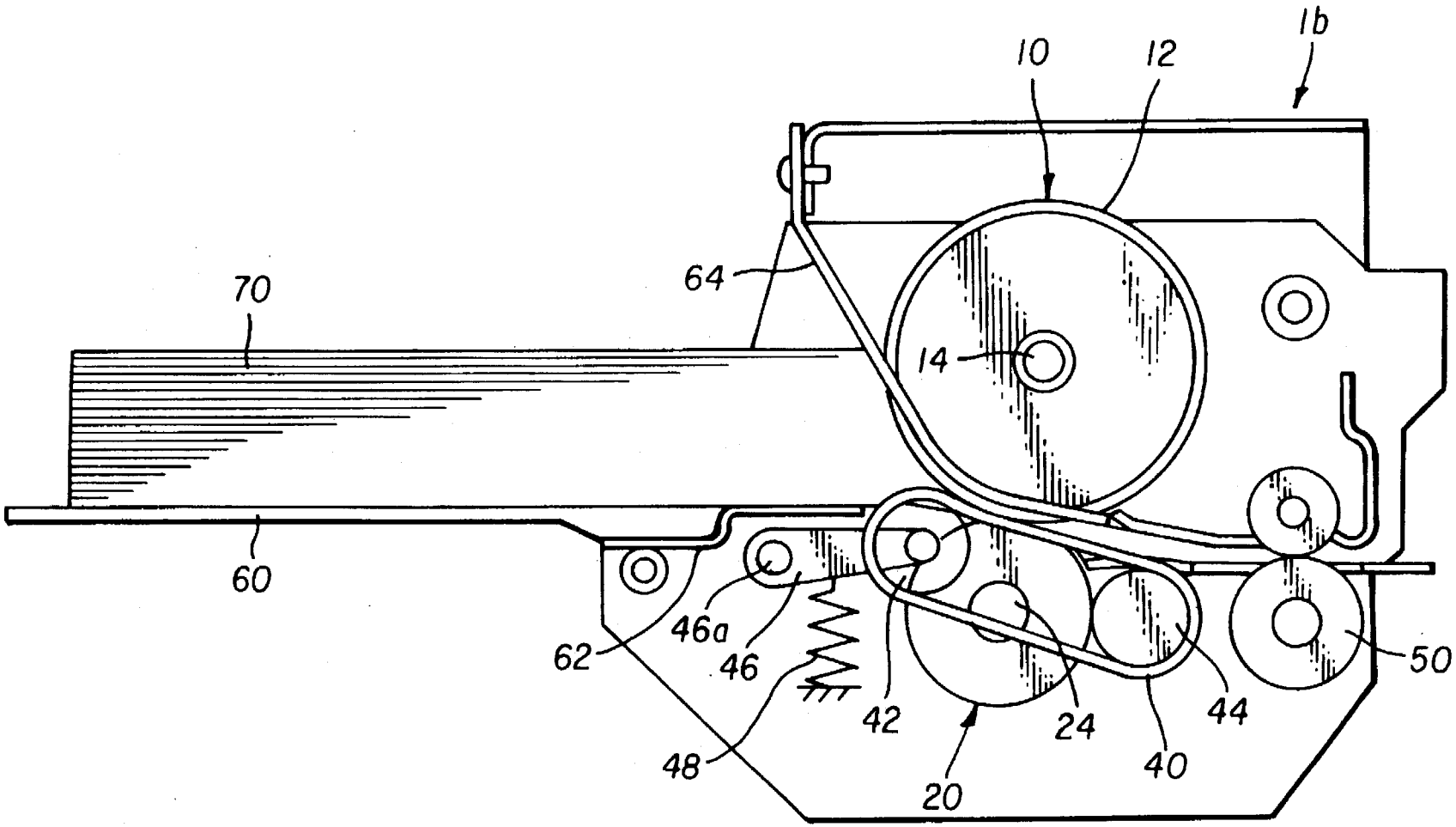
FIG. 4 is a frontal view showing the arrangement of another embodiment of the paper transport apparatus according to the present invention.
Figure 5:
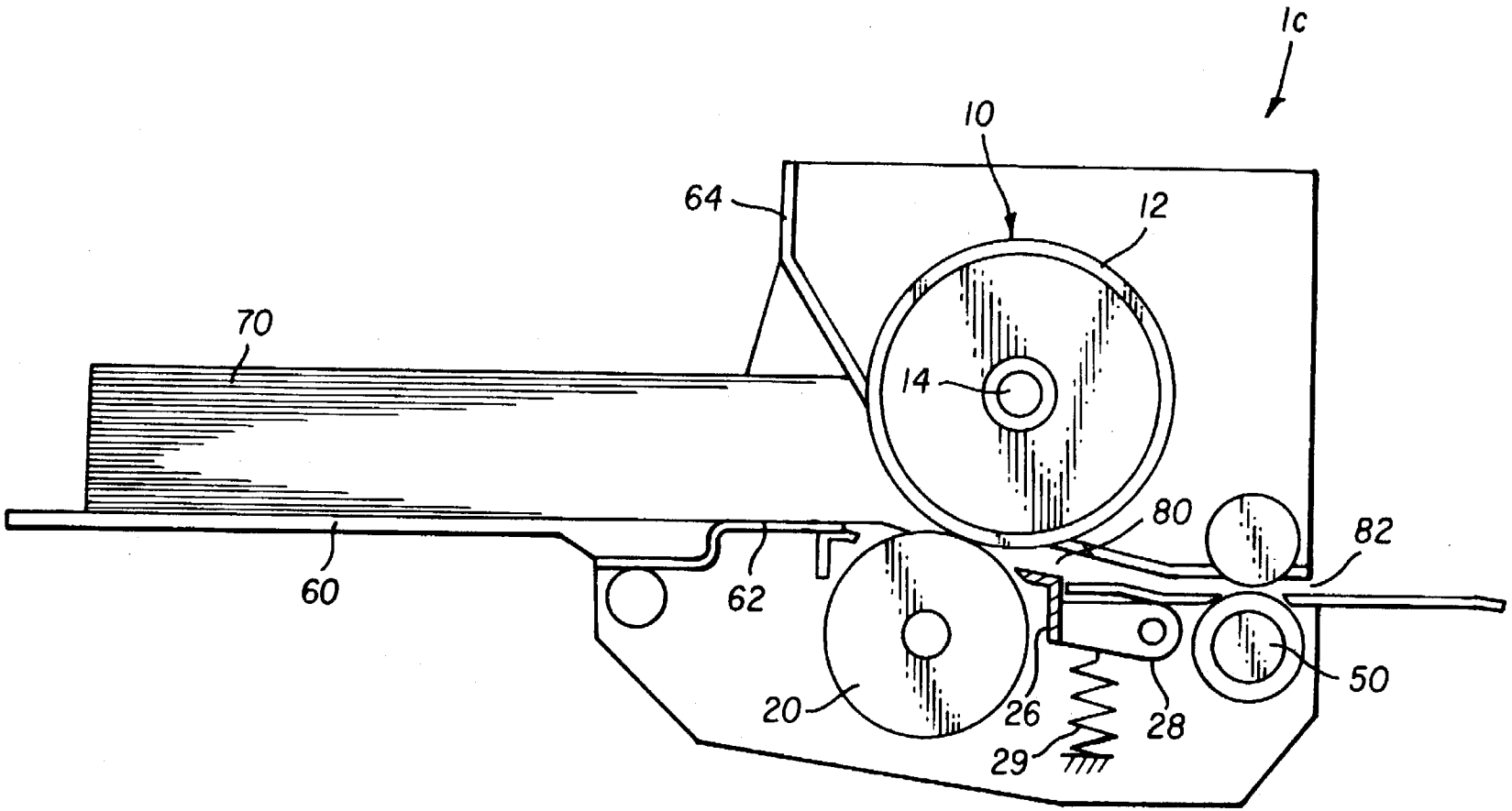
FIG. 5 (PRIOR ART)
FIG. 5 is a frontal view showing the arrangement of a conventional prior art paper transport apparatus.
Figure 6:
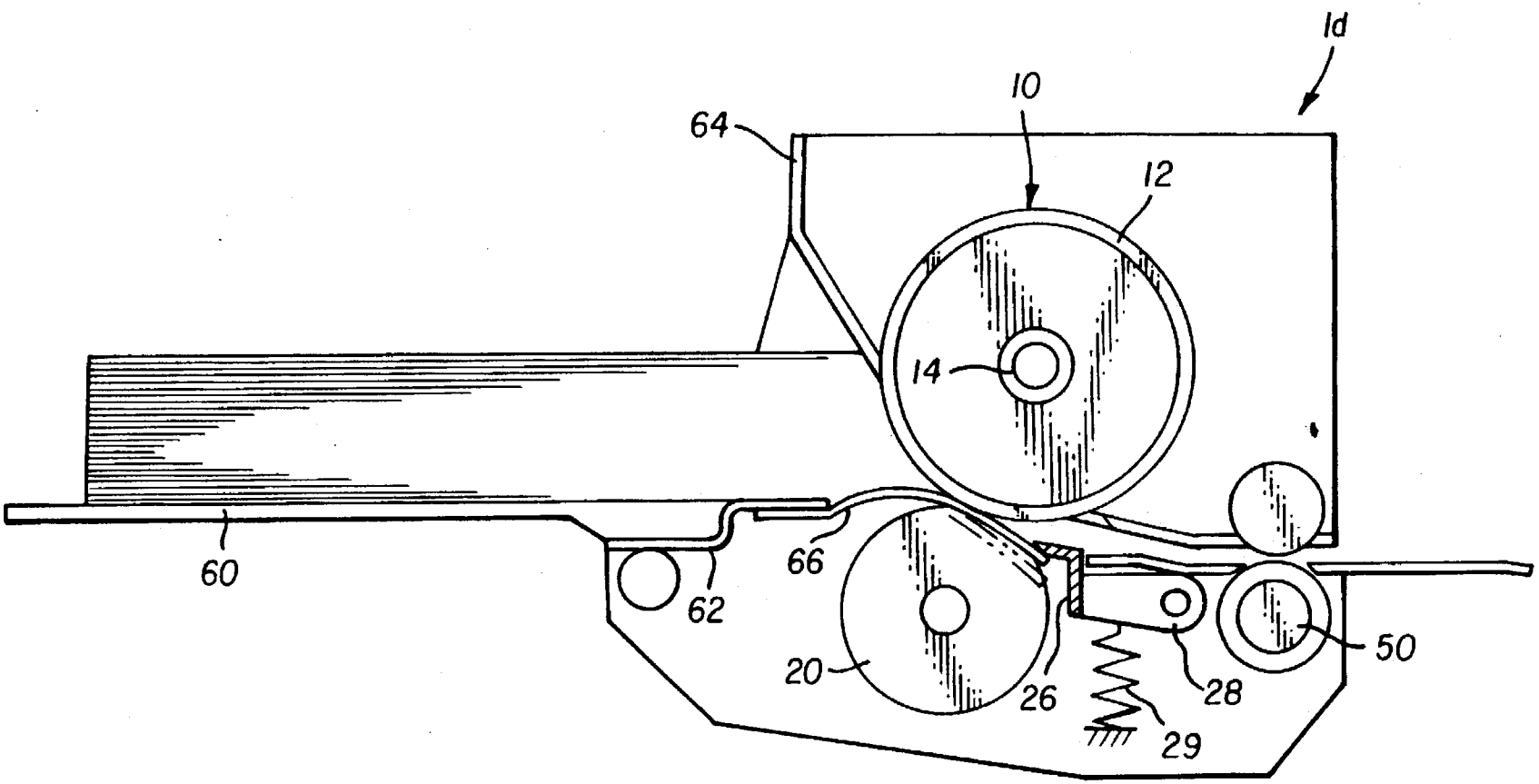
FIG. 6 (PRIOR ART)
FIG. 6 is a frontal view showing another arrangement of a conventional prior art paper transport apparatus.

A second embodiment of the paper transport apparatus according to this invention will next be described with specific reference to FIG. 4. While the arrangement of the paper transport apparatus 1*b* is similar to that of the first embodiment, a different is that instead of the pull-in rollers 32, there are pull-in belts 40 which are mounted around a first roller 42 and a second roller 44. As shown in FIG. 4, the first roller 42 is supported by an arm 46 which is supported by a pull-in roller spring 48 and pivots about a shaft 46*a*. The pull-in belts 40, first and second rollers 42 and 44, arm 46 and pull-in roller spring 48 constitute a belt conveyor mechanism, which is provided where the pull-in rollers 32 are provided in the first embodiment. That is, the pull-in belts 40 are disposed between the annular members 22 of the retard roller 20.

The operation of the paper transport apparatus 1*b* according to the above arrangement will now be described. A sheet of paper is fed in the transport direction between the feed roller 10 and the pull-in belts 40 rotated by the feed roller 10. Similarly to the first embodiment, when multiple sheets of paper are fed, the first roller 42 retracts below the feed baffle 62, and the extra sheets are moved back by the retard roller 20. However, when a single sheet is fed, the pull-in belts 40 prevent the retard roller 20 from moving the sheet backward before the sheet can be taken by the feed roller 10, thereby ensuring that the sheet is transported properly.

As the pull-in belts 40 can spin freely, they are rotated by the reverse movement of the sheets, thereby helping to ensure that the sheets are returned, while when a single sheer is fed, the pull-in belts 40 prevent the retard roller 20 from moving the sheet backward before the sheet can be taken by the feed roller 10. Furthermore, the pull-in belts 40 ensure a secure contact between the sheet and the feed roller 10, and the ability of the pull-in belts 40 to rotate freely helps to facilitate smooth paper transport by the feed roller 10.

Thus, the paper transport apparatus according to the present invention is provided with a rotational member that enables sheets of is paper to be reliably transported without skewing or overlapping. When the rotational member is provided upstream of the feed roller relative to the direction of paper transport, the rotational member can ensure that sheets are transported reliably by preventing the retard roller moving a sheet backward before the sheet can be taken by the feed roller.

The invention has been described in detail with particular reference to a preferred embodiment thereof, but it will be understood that variations and modifications can be effected within the spirit and scope of the invention as described hereinabove and as defined in the appended claims.

We claim:

1. A paper transport apparatus comprising:

a feed roller for feeding a sheet of paper along a transport path in a transport direction, a retard roller for moving sheets of paper, other than a sheet to be transported by said feed roller, in a direction opposite to that of said transport direction, said feed roller and said retard roller being arranged in contact and in mutual opposition relative to said transport path, and a rotational member rotatably supported in opposition to said feed roller relative to said transport path, said rotational member and means urging against said feed roller such that said rotational member can be moved away from said feed roller, at a location upstream of the position of contact between said retard roller and said feed roller, relative to the transport direction.

* * * * *